United States Patent [19]

Hirose et al.

[11] Patent Number: 4,709,711

[45] Date of Patent: Dec. 1, 1987

[54] CIGARETTE FILTER, METHOD AND APPARATUS FOR MAKING SAME

[75] Inventors: Ichiro Hirose; Takayoshi Sagawa, both of Hiratsuka, Japan

[73] Assignee: The Japan Tobacco & Salt Public Corporation, Japan

[21] Appl. No.: 581,299

[22] Filed: Feb. 17, 1984

[30] Foreign Application Priority Data

Jul. 21, 1983 [JP] Japan ..... 58-131975

[51] Int. Cl.[4] ..... A24D 3/04

[52] U.S. Cl. ..... 131/336; 131/361; 131/339

[58] Field of Search ..... 131/339, 336, 341, 344, 131/360, 361, 362, 365, 95

[56] References Cited

U.S. PATENT DOCUMENTS

| | | | |
|---|---|---|---|
| 269,256 | 12/1882 | Bourgeois | 131/336 |
| 1,718,122 | 6/1929 | De Shon | 131/336 |
| 3,359,988 | 12/1967 | Thomson | 131/336 |
| 3,865,016 | 2/1975 | Greve . | |
| 4,503,869 | 3/1985 | Cantrell et al. | 131/336 |
| 4,582,071 | 4/1986 | Westcott et al. | 131/336 |
| 4,587,982 | 5/1986 | Adams et al. | 131/336 |

FOREIGN PATENT DOCUMENTS

| | | | |
|---|---|---|---|
| 0059042 | 9/1982 | European Pat. Off. . | |
| 1280782 | 11/1960 | France . | |
| 2373975 | 7/1978 | France . | |
| 864247 | 3/1961 | United Kingdom . | |
| 2090117 | 7/1982 | United Kingdom | 131/339 |
| 2095532 | 10/1982 | United Kingdom | 131/336 |

*Primary Examiner*—J. Millin

[57] ABSTRACT

A cigarette filter as well as a method and apparatus for making it is disclosed. The cigarette filter is rolled in first and second plug paper and then in tip paper. The first plug paper is comparatively thin and has a smooth surface. While the second plug paper is comparatively thick and has a plurality of holes or grooves preliminarily punched on its surface. By adequately rolling the filter in the first and second plug paper, a plurality of air channels are defined on the periphery of the filter so that smoke is inhaled by a smoker as if it is enclosed by air. The smoker can enjoy its light taste without jeopardizing a sense of smoking. The filter is made by a method comprising forming a continuous filter rod by rolling filter material in the first plug paper, rolling the filter rod in the second plug paper having a plurality of holes preliminarily punched and cutting the rod in a predetermined length so that a plurality of channels reaching the suction end are formed on the second plug paper. The apparatus comprises a principal apparatus for making the filter rod and a punching apparatus for forming punch holes on the plug paper which is subsequently supplied to the principal apparatus.

3 Claims, 13 Drawing Figures

CIGARETTE FILTER, METHOD AND APPARATUS FOR MAKING SAME

BACKGROUND OF THE INVENTION

The present invention relates to a cigarette filter, method and apparatus for making the same.

It is already known to connect a filter to a cigarette having means for introducing air therein in order to decrease the amount of smoke in inhaled content. Some of such examples are seen in the Japanese patent publication before examination No. 55-141184, 57-122784 and 57-132873.

In the prior art mentioned above, such introduced air penetrates along the periphery of the filter and is inhaled by a smoker as if it encloses a flow of thick smoke flowing through the central portion of the filter. Therefore, the amount of smoke inhaled by the smoker is diminished or diluted, thus producing light taste to the smoker's satisfaction.

In the Japanese patent publication before examination No. 55-141184, it is disclosed that both filter and plug paper are formed of grooves on their peripheries by heating in advance and when said filter is integrated with a cigarette by tip paper, air passages are defined by said tip paper and grooves. In this case, since the grooves are molded by heating, high speed production is difficult to attain. Furthermore, when heating is applied in the molding process, the grooved area is inclined to shrink diminishing the cross sectional dimension of the filter where smoke flows through and creating non-uniformity in the cross sectional dimensions of the grooves. As a result, the amount of introduced air penetrating along the periphery of the filter becomes uneven.

On the other hand, in the Japanese patent publication before examination No. 57-122784, plug paper is applied to the filter by a conventional method, and then the filter and cigarette are integrated by tip paper having a plurality of knobs formed in advance for forming channels extending in the axial direction so that air passages are defined by said plug paper and channels. In this prior art, it is extremely difficult to speed up the work to connect the filter to the cigarette by tip paper.

The present invention is accomplished in order to overcome the above mentioned disadvantages of the prior art.

SUMMARY OF THE INVENTION

It is therefore an object of the present invention to provide a cigarette filter which serves to dilute cigarette smoke without jeopardizing a smoker's sense of smoking.

It is another object of the invention to provide a cigarette filter having a plurality of channels therearound without diminishing its sectional dimension and without enlarging its outer periphery.

It is a further object of the present invention to provide a method for making a cigarette filter to attain high speed connection of the filter and cigarette.

It is a still further object of the invention to provide an improved apparatus for making a cigarette by which high speed production of the filter is attained.

To achieve the above objects and others there is essentially provided a cigarette filter comprising a filter, one end of which serves as a suction end, a comparatively thin first plug paper being placed upon said filter and comparatively thick second plug paper being placed upon said second plug paper with respect to said filter, said second plug paper being formed of a plurality of channels extending in the axial direction and the ends of said channels reaching the section end thereof.

There is also provided a method for making a cigarette filter comprising forming a continuous filter rod by means of rolling filter material in said first plug paper, rolling said filter rod in said second plug paper having grooves punched in advance, and cutting the rod in a predetermined length so that a plurality of channels reaching the suction end of said filter rod are formed on the second plug paper.

There is still provided an apparatus for making a cigarette filter comprising a principal apparatus including means for transferring the filter, rolling dies, bond suppliers, dryers and a cutter, and a punching apparatus for punching the plug paper which is to be supplied to said principal apparatus, characterized in that said punching apparatus is timely operated with respect to said principal apparatus.

DETAILED DESCRIPTION OF THE INVENTION

Preferred embodiments of the present invention will be described hereunder with reference to the accompanying drawings.

Figure 1:
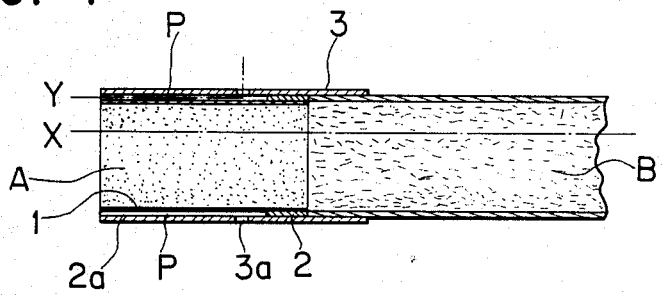
FIG. 1 is a sectional view of a filter connected to a cigarette according to the present invention.

In FIG. 1, A is a filter and B is a cigarette. First and second plug papers, preferably air impervious ones, are provided at the periphery of the filter A. A plurality of channels 2*a*, 2*a* are defined in said comparatively thick second plug paper from the middle part thereof to the suction end in the axial direction leaving a smooth surface at its cigarette side. 3 denotes a tip paper connecting said filter A and cigarette B. Said tip paper has air inlets 3*a*, 3*a* opened into said channels 2*a*, 2*a*. Instead of providing said air inlets 3*a*, 3*a* on said tip paper, said tip paper may be made of air pervious material. An air passage P for introducing outside air is defined by said channels 2*a*, 2*a*, paper 3 and first plug paper. Because of this construction, the respective smoke and air flows are separately inhaled.

Figure 2:
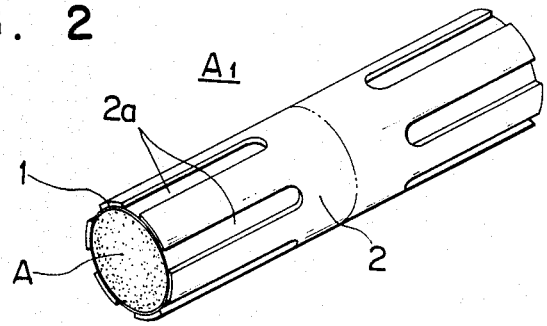
FIG. 2 is a perspective view showing the filter in FIG. 1.
Figure 3:
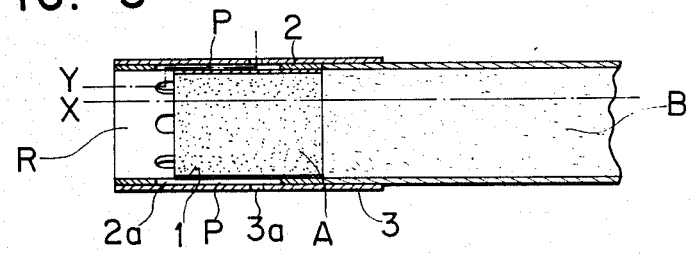
FIG. 3 is a sectional view of another embodiment of the filter showing how it connects with a cigarette.
Figure 4:
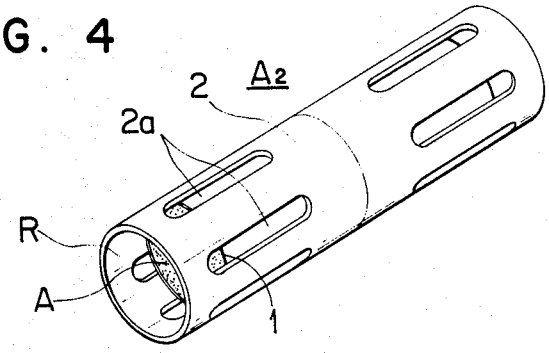
FIG. 4 is a perspective view of the filter in FIG. 3.
Figure 5:
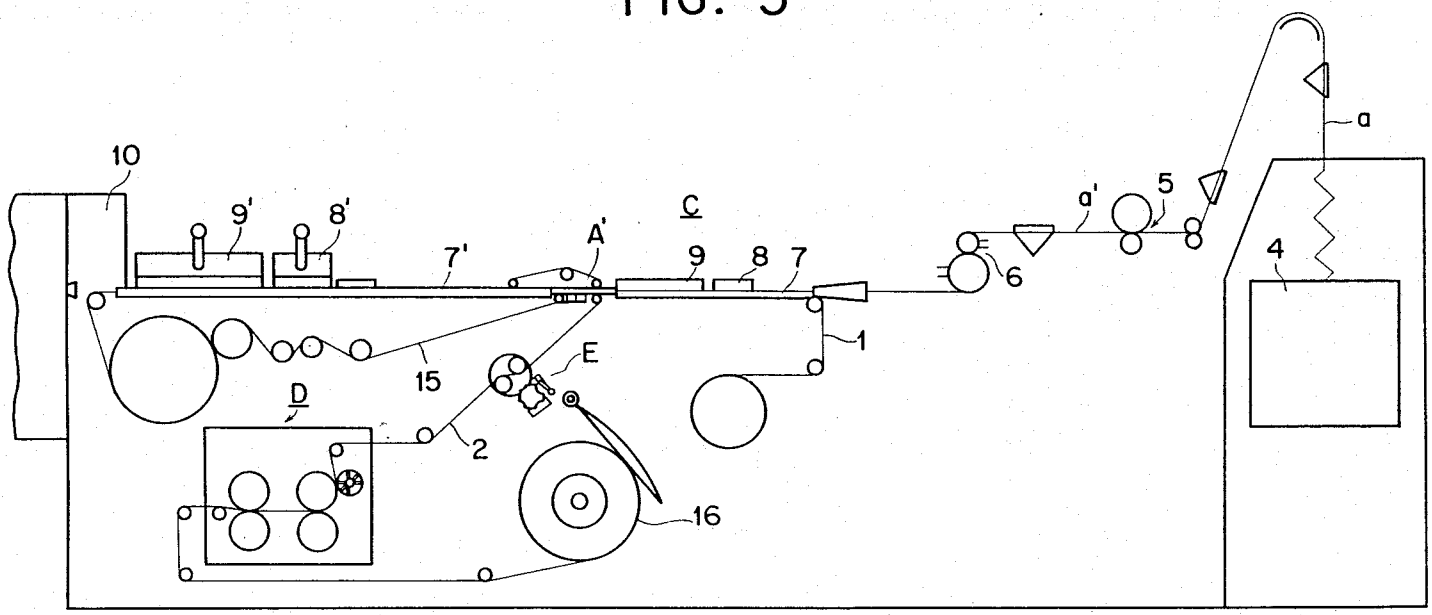
FIG. 5 is a schematic view of an apparatus for making the filter in FIG. 2.
Figure 6:
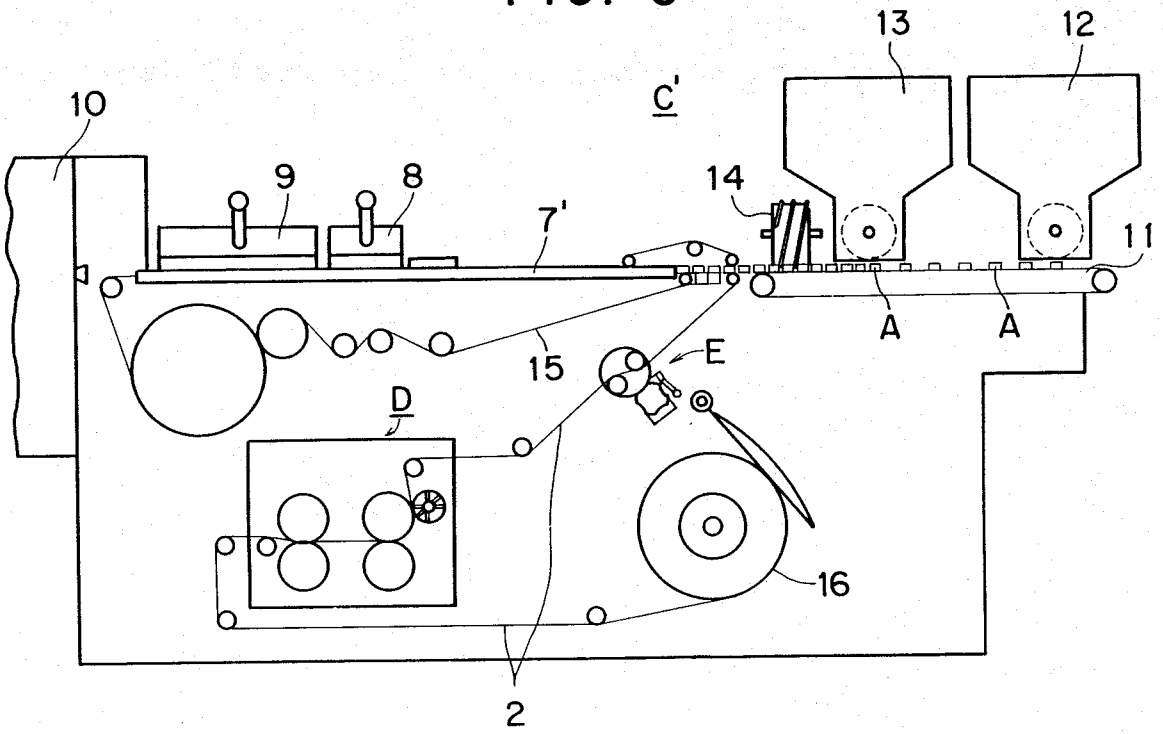
FIG. 6 is a schematic view of an apparatus for making the filter in FIG. 4.

In FIGS. 3 and 4, the comparatively thick second plug paper is provided on the filter in a manner such that one end of said second plug paper is protruded over the suction end of filter A defining an empty chamber R inside thereof. A plurality of channels 2a, 2a are provided on the second plug paper exceeding the suction end of the filter A and therefore, said tip paper 3 is also provided on the second plug paper 2 in a way exceeding the suction end of said filter rod A. Said plurality of channels are opened into said chamber R at their one ends positioned at the middle part of such protruded second plug paper 2. Therefore, there is no risk that a smoker's lips will cover the opening end of said air passage P when in use. FIGS. 5 and 6 show schematice views of filter making apparatus C, C'. The apparatus C in FIG. 5 is for making the filter shown in FIGS. 1 and 2. On the other hand, the apparatus C' in FIG. 6 is for making the filter shown in FIGS. 3 and 4.

In FIG. 5, fiber a for making a filter is drawn out of a material tank 4 and stretched out by a guide roller 5 in sheet form a' and then transferred to a rolling die 7 together with the first plug paper 1 through a plasticizer supplying roller 6. After treated by a bond feeder 8 and a dryer 9, it becomes a continuous filter rod A' and is transferred to the subsequent process.

Said filter rod A' is further supplied with a second plug paper 2 and then transferred to a rolling die 7'. After treated by a bond feeder 8' and a dryer 9', it is cut into a predetermined length by a cutter 10. As a result, a continuous two pieces or its integral multiples of filter A is produced as shown in FIG. 2.

In FIG. 6, hoppers 12 and 13 for said filter A are spacedly provided on a multi-pore conveyer 11 having sucker means in the progressing direction. After rolled in the first plug paper 1 and cut into a predetermined length, the filter A is extruded onto said multi-pore conveyer 11 at fixed spaces from the hoppers 12 and 13. In the filters A arrangement formed by those extruded from the hopper 12, another filters A extruded by the hopper 13 are arranged one after another. The spaces between such two adjacent filters A are adjusted by a worm 14 positioned at the end of said multi-pore conveyer 11 and thereafter transferred to the subsequent rolling process. The details of the above are disclosed by the Japanese patent publication after examination No. 40-20239.

The filters A which are arranged in regular order as mentioned above are transferred to said rolling die 7' together with the second plug paper by a woven belt 15 and treated by the bond feeder 8 and dryer 9 and then cut by the cutter 10 into a predetermined length. As a result, a continuous two pieces or its integral multiples of filter A is obtained as shown in FIG. 4.

Figure 7:
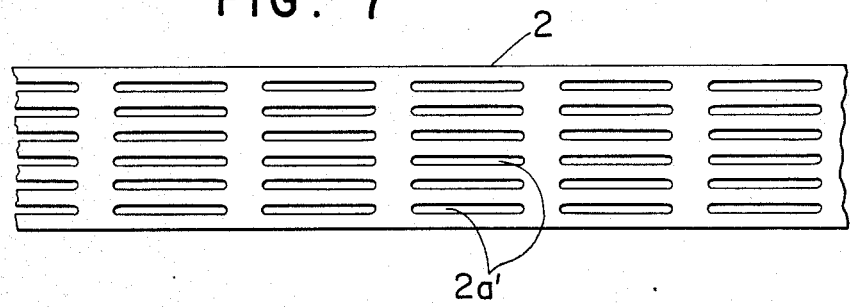
FIG. 7 is a plan view of second plug paper having grooves punched.
Figure 11:
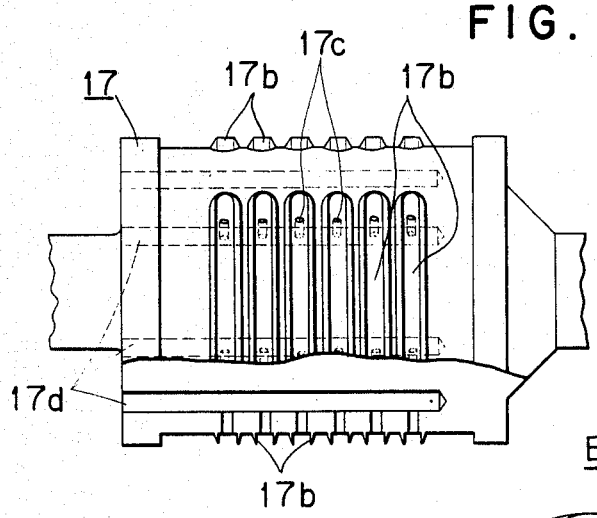
FIG. 11 is a partly broken plan view showing an important part of the die cylinder.
Figure 13:
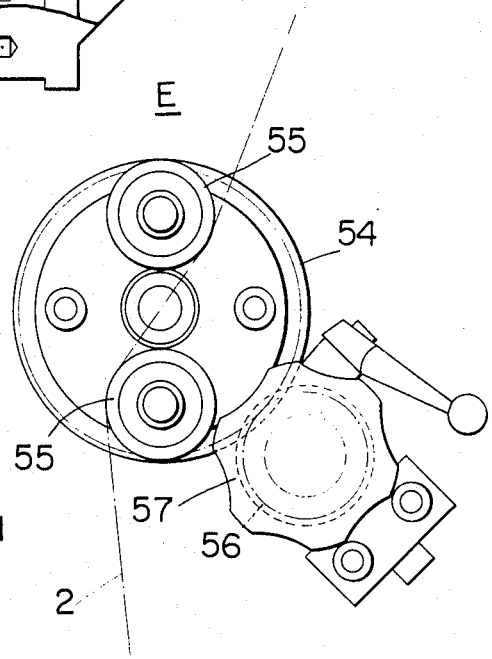
FIG. 13 is a front view of the regulator for regulating the transfer of the second plug paper.
Figure 12:
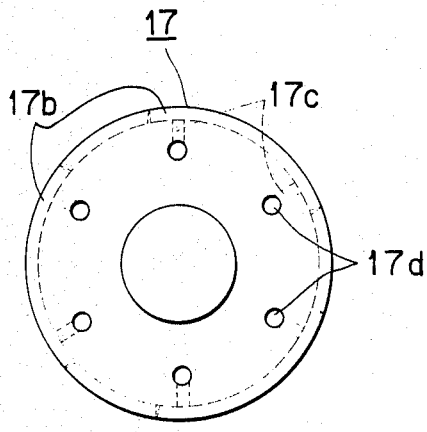
FIG. 12 is a side view of the die cylinder.
Figure 8:
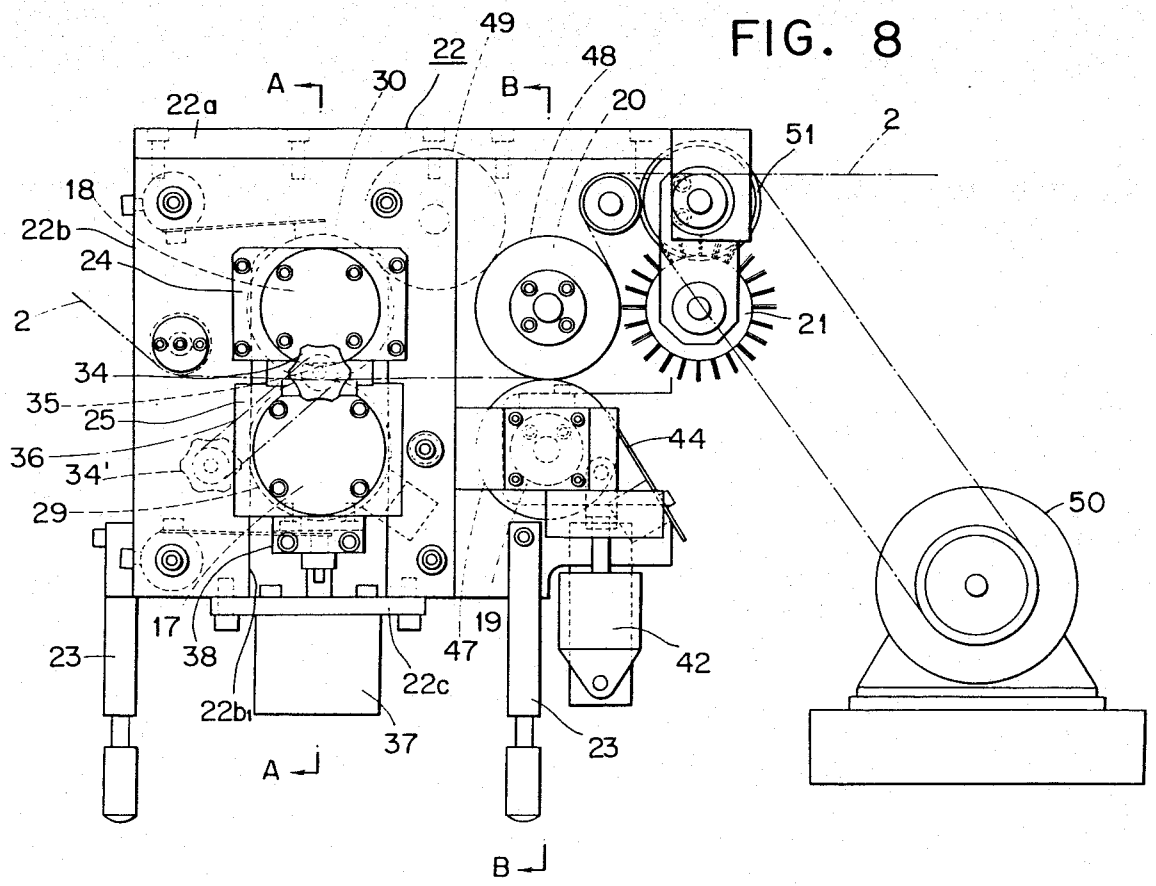
FIG. 8 is a side view of the punching apparatus.
Figure 9:
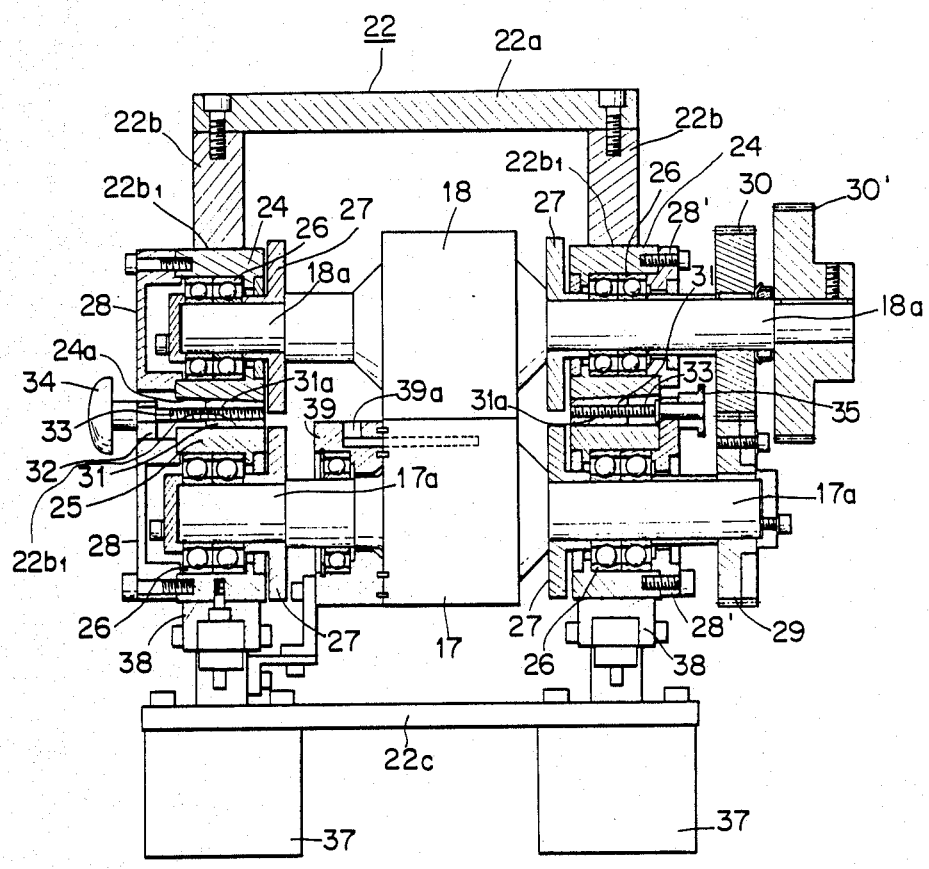
FIG. 9 is a sectional view taken on line A—A in FIG. 8.
Figure 10:
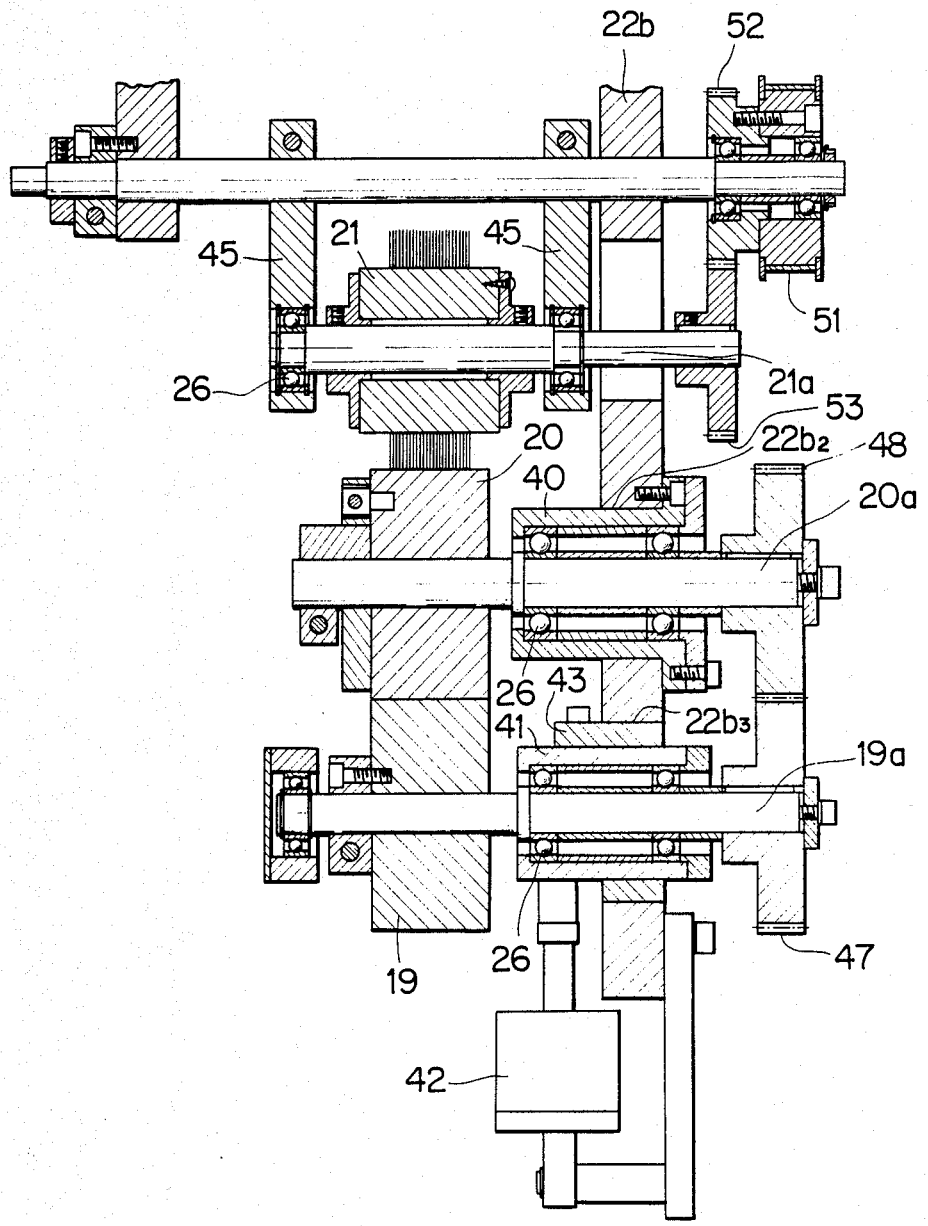
FIG. 10 is a sectional view taken on line B—B in FIG. 8.

In FIGS. 5 and 6, the comparatively thick second plug paper 2 sent out by a drum 16 is punched by a punching apparatus D to form a number of holes or grooves 2a' as shown in FIG. 7.

Said punching apparatus D comprises a form cutting division including a die cylinder 17 and an anvil cylinder 18 and an odds-and-ends separator division including a grooved drum 19 and a pin drum 20. As first, the second plug paper is formed form-cut or punching cut by the cylinder 17 and 18 and then the odds and ends created are removed while passing through the drums 19 and 20 in the odds-and-ends separator division, and finally the remaining odds and ends are completely cleaned by a brush roll 21.

A frame 22 of said punching apparatus D comprises a base plate 22a, side plates 22b, 22b, upper ends of which are fixedly secured to said base plate 22a and a cylinder plate 22c provided between said side plates at their base portions. Said frame 22 is provided with supporting columns 23. Notches $22b_1$, $22b_1$ are formed on the side plates 22b, 22b vertically spacedly with which respective anvil housings 24, 24 and die housings 25, 25 are engaged.

An axis 18a of the anvil cylinder 18 is carried by said anvil housings 24, 24 by means of bearings 26. An axis 17a of said die cylinder 17 is carried by said die housings 25, 25 by means of the bearings 26. 27, 27 are bearing collars and 28, 28' are bearing covers. Said axes 17a, 19a are extended outwardly through one of the cover bearings 28'. At the respective ends of said axes 17a, 19a, gears 29, 30 intermeshing each other are securely fixed. An input gear 30' is further provided on the foremost end of said axis 18a.

In the anvil housing 24, a tapered contact surface 24a is formed at the portion opposite the die housing 25. A wedge 31 provided intermediate the anvil housing 24 and die housing 25 is abutted against said contact surface 24a. A threaded hole 31a is formed in the wedge 31. A threaded rod 33 rotatably supported by a set plate 32 is threaded into the thread hole 31a and by threading the threaded rod 33, said wedge 31 is moved in the axial direction, whereby to control the distance between the die cylinder 17 and anvil cylinder 18. Said threaded rod 33 is directly driven by a knob 34 or indirectly driven by a knob 34' through a sprocket 35 and chain 36.

The die housings 25, 25 are connected to bellows ram cylinders 37, 37 by way of set pieces 38, 38 and are compressed toward the anvil housing 24 leaving a space restricted by the wedge 31, thus the axis of the die cylinder 17 is fastened while keeping a fixed distance between said die cylinder 17 and said anvil cylinder 18.

Said anvil cylinder 18 has a smooth peripheral surface, while on the periphery of said die cylinder 17, there are provided six pieces of cutting blade, each of which has an elongated, ring shaped configuration as well as a concave surface. These six pieces of cutting blade are arranged in parallel in the axial direction and extending in the circumferential direction. Another two lines of such six pieces of cutting blade are spacedly provided thereon in the circumferential direction so that such three lines of 6 pieces of cutting blades form one group of cutting blade. An air outlet 17c is provided at said blade 17b in order to prevent the odds and ends from sticking thereto. By way of ventilation holes 17d, the air outlet 17c is opened into side portion of said die cylinder 17. A blow ring 39 is tightly secured to said side portion of the die cylinder 17. Compressed air is sent into said air outlet 17c through an air conduit 39a which is opened into the same place as the ventilation hole 17d through a compressed air pipe (not shown) which is connected to said blow ring 39.

Two drums 19, 20 in the odds-and-ends separator division are held by one of the side plates 22b. Said pin drum housing 40 for carrying the axis 20a of the pin drum 20 through the bearing 26 is fixedly mounted on a recess $22b_2$ of the side plate 22b. The grooved drum 19 is vertically movably engaged with an elongated slot $22b_3$ in the side plate 22b and compressed by the bellows ram cylinder 42 connecting to the housing 39 toward the pin drum housing 40. At this time, a fixed compression position is established by a spacer 43 located intermediate the upper end of the elongated slot $22b_3$, and the pin drum housing 40 by which a distance between said grooved drum 19 and pin drum 20 is adjusted.

Six pieces of ring shaped grooves (not shown) are formed on the grooved drum 19 such that the ring shaped grooves are in accord with the shape of odds and ends formed by said six pieces of blades 17*b*, respectively. A tip portion of a craper 44 is positioned on said ring shaped grooves.

As mentioned above, after form-cutting is formed in the form cutting division, the odds and ends are removed in the odds-and-ends separator division. The reasons why there are not completely punched out by the die cylinder 17 are; (a) for prolonging the blade life, and (b) for preventing the blade from getting damage caused by piles of odds and ends between the blades.

After the odds and ends are removed, the above mentioned punched hole 2*a*' are formed on the second plug paper.

An axis 21*a* of the brush roll 21 is supported by the frame 22 through the bearing 26 and the odds and ends remained unremoved in the odds-and-ends separator division are completely removed by the brush roll 21.

Intermeshing gears 47, 48 are provided on the axes of grooved drum 19 and pin drum 20, respectively. The gears 47, 48 are the same as the gears 29, 30 mounted on said axes 17*a*, 18*a*. Power is transmitted to the gears 47, 48 by the gear 30 through the same sized intermediate gear. As a result, the die cylinder 17, anvil cylinder 18, grooved drum 19 and pin drum 20 are revolved at the same speed. Time controlled power is transmitted into the input gear 30' from said filter making apparatuses C, C' by means of chain transmission. The brush roll 21 is driven by another motor 50 through a pulley 51 and gears 52, 53 by means of belt transmission.

By driving the punching apparatus D timely with respect to the filter making apparatus C, C', the punched holes 2*a*', 2*a*' or channels 2*a*, 2*a* are formed at fixed places exceeding the suction end of the filter A as shown in FIGS. 3 and 4.

A regulator E for transferring the second plug paper 2 is located intermediate the punching apparatus D and filter making apparatuses C, C'.

The regulator E comprises a gear 54, two guide rollers symmetrically positioned with respect to the central portion of the gear 54, a driving gear 56 being engaged with said gear 54 and a knob 57 being secured to said gear 56. Fine adjustment is made by displacing the guide rollers 55, 55 in the transferring direction of the second plug paper using the knob 57.

Since the present invention is such constructed as mentioned above, a plurality of channels can be made on the periphery of the filter in the axial direction without diminishing the sectional area for smoke to flow and without enlarging the peripheral portion thereof. Such filters can be continuously produced in the rolling process of the filter. Furthermore, said channels can be formed by means of accurately forming the punching cut on the second plug paper with respect to said filter in the filter making apparatus.

What is claimed is:

1. A cigarette filter for a cylindrical cigarette comprising:

a cylindrical filter having a suction end, a smoke inlet end and an outer surface between said ends;

a comparatively thin air impervious first plug paper wrapped around the outer surface of the filter to form an air impervious tubular cover for said filter, said first plug paper tubular cover having an outer diameter less than the outer diameter of the cylindrical cigarette to be connected to the smoke inlet end of the filter in an axial alignment therewith and having an end coplanar with said filter smoke inlet end to abut a smoke outlet end of the cigarette associated with the filter, whereby the filter is made impervious to air entering radially through said outer surface and pervious to smoke flowing axially of said cylindrical filter;

a comparatively thick second plug paper wrapped around the first plug paper to form a tubular case for said air impervious tubular cover, said tubular case having a plurality of axially extending channels, said second plug paper tubular case having an outer diameter substantially equal to that of the cylindrical cigarette and having an inlet end coplanar with said tubular cover first end and said filter smoke inlet end and abutting said cigarette smoke outlet end said first plug paper and said second plug paper being wrapped around said cylindrical filter and then all of just-mentioned elements cut off together to form a coplanar configuration between said filter smoke inlet end and said first plug paper end and said second plug paper inlet end; and a tip paper wrapped around the second plug paper tubular case, said channels being operable as passages or air captured between the second plug paper tubular case and said tip paper and the smoke outlet end of the cigarette which is located adjacent to the filter, and said air passages being separated from smoke passages through the filter by said air impervious tubular cover.

2. A cigarette filter according to claim 1, wherein said second plug papers is air impervious.

3. A cigarette filter for a cylindrical cigarette comprising:

a cylindrical filter having a suction end, a smoke inlet end and an outer surface between said ends;

a comparatively thin air impervious first plug paper wrapped around the outer surface of the filter to form an air impervious tubular cover for said filter, said first plug paper tubular cover having an outer diameter less than the outer diameter of the cylindrical cigarette to be connected to the smoke inlet end of the filter in an axial alignment therewith and having an end coplanar with said filter smoke inlet end to abut a smoke outlet end of the cigarette associated with the filter, whereby the filter is made impervious to air entering radially through said outer surface and pervious to smoke flowing axially of said cylindrical filter;

a comparatively thick second plug paper wrapped around the first plug paper to form a tubular case for said air impervious tubular cover, said tubular case having a plurality of axially extending channels, said second plug paper tubular case having an outer diameter substantially equal to that of the cylindrical cigarette end having an inlet end coplanar with said tubular cover first end and said filter smoke inlet end and abutting said cigarette smoke outlet end, said second plug paper being oriented to protrude over the suction end of said filter to define an empty chamber with ends of said channels reaching said suction end of the filter; and a tip paper wrapped around the second plug paper tubular case, said channels being operable as passages of air captured between the second plug paper tubular case and said tip paper and the smoke outlet end of the cigarette which is located adjacent to the filter, and said air passages being separated from smoke passages through the filter by said air impervious tubular cover.

* * * * *